US005597254A

United States Patent [19]

Vasas

[11] Patent Number: 5,597,254

[45] Date of Patent: Jan. 28, 1997

[54] WIPER WITH VANES FOR USE WITH VISCOUS COSMETICS

[75] Inventor: Martin M. Vasas, Fairfield, Conn.

[73] Assignee: The Bridgeport Metal Goods Manufacturing Company, Bridgeport, Conn.

[21] Appl. No.: 533,362

[22] Filed: Sep. 25, 1995

[51] Int. Cl.[6] ..... A45D 40/26

[52] U.S. Cl. ..... 401/122; 401/129; 132/218

[58] Field of Search ..... 401/122, 129; 132/218

[56] References Cited

U.S. PATENT DOCUMENTS

| | | | |
|---|---|---|---|
| 2,627,619 | 2/1953 | Gagen | 401/122 |
| 3,214,782 | 11/1965 | Masters et al. | 401/122 |
| 3,861,810 | 1/1975 | Vasas | 401/122 |
| 4,403,624 | 9/1983 | Montgomery | 401/122 X |
| 4,802,797 | 2/1989 | Cole | 401/122 |
| 5,349,972 | 9/1994 | Dirksing et al. | 401/122 X |

FOREIGN PATENT DOCUMENTS

| | | | |
|---|---|---|---|
| 9101097 | 2/1991 | WIPO | 401/122 |

*Primary Examiner*—Steven A. Bratlie
*Attorney, Agent, or Firm*—Parmelee, Bollinger & Bramblett; James R. Frederick

[57] ABSTRACT

A cosmetics container includes a bottle defining a chamber for containing cosmetics, the bottle including a threaded neck, and a cap removably secured to the neck. The cap has an applicator rod for extending through the neck into the cosmetics chamber and applicator at the distal end of the rod for carrying cosmetics. A wiper has i) a sleeve mounted in the bottle neck, the sleeve defining an outlet through the neck from the cosmetics chamber, and ii) a conical wiper diaphragm extending from the sleeve across the outlet and descending into the cosmetics chamber below the neck. The conical wiper diaphragm defines a central wiper orifice for accommodating passage of the applicator rod and applicator and for wiping excess cosmetics therefrom as the applicator rod and applicator are withdrawn from the cosmetics chamber. A plurality of substantially evenly spaced-apart vanes extend downwardly from the lower surface of the wiper diaphragm to below the wiper orifice, each vane having a leading edge and a trailing edge, the leading edge of each vane joined with the lower surface of the wiper diaphragm adjacent the wiper orifice, and each vane extending angularly outwardly from the wiper orifice to its trailing edge. Adjacent vanes define a flow channel therebetween for conveying wiped excess cosmetics outwardly from the wiper orifice and for mixing cosmetics, the plurality of vanes defining a plurality of such flow channels. A second, more flexible finishing wiper is provided within the first wiper.

25 Claims, 8 Drawing Sheets

WIPER WITH VANES FOR USE WITH VISCOUS COSMETICS

FIELD OF THE INVENTION

The invention herein relates to a wiper for use in a cosmetics container, the wiper having vanes for channeling wiped excess viscous cosmetics away from the wiper orifice.

BACKGROUND OF THE INVENTION

Some cosmetics applied by means of an applicator are highly viscous. Such cosmetics include mascaras, as well as some eye shadows and concealers. The latter products benefit from blending to maintain uniform color, thereby overcoming any separation during storage time in the cosmetics container. Some less viscous-cosmetics also benefit from blending to maintain even color.

These cosmetics are provided in a container comprising a bottle and a cap, with an applicator rod extending from the cap through the neck of the bottle. An applicator is provided at the distal end of the applicator rod to accumulate cosmetics. Applicators for mascara are often brushes with radial bristles. Pads of various types are used as applicators with shadows and concealers.

Excess cosmetics are removed from the applicator rod and applicator, as they are removed from the bottle, by a wiper positioned in the neck of the bottle. The wiper typically comprises a wiper diaphragm deployed across the neck of the bottle and defining a central wiper orifice. As the applicator rod and applicator are withdrawn, the excess cosmetics is scraped off the applicator rod and wiped from the applicator, so that the applicator emerges from the bottle with a proper amount of cosmetics for use.

The scraped and wiped off excess cosmetics are sufficiently viscous that they do not readily drop back into the bottom of the bottle, but tend to accumulate on the under side of the wiper diaphragm. As the cosmetics accumulate, they also spread and transfer to the upper part of the bottle, also known as the "head space." The accumulated cosmetics also tend to have a relatively large surface area to volume ratio, and tend to dry out and cake in the head space area. The build-up of cosmetics, whether dried out or merely accumulated, can eventually interfere with proper wiping action through the wiper orifice.

The shadows and concealers and, to a lesser extent, the mascaras may tend to separate in the cosmetics container during storage periods, and therefore do not maintain uniformity or blended coloring. These cosmetics may be thin enough to avoid the problem of build-up in the area of the wiper, but are too viscous to achieve the blending by shaking, and the result over time is a less desirable product.

Accordingly, it is known in the cosmetics and cosmetics packaging industry that the condition of the cosmetics can be improved and the operation of the applicator is most efficient if excess cosmetics scraped and wiped off by the wiper are not permitted to accumulate under the wiper, but are instead removed from the vicinity of the wiper orifice and preferably returned to the main body of cosmetics stored in the lower part of the cosmetics bottle. Although the desirability of such action within the cosmetics bottle has been known, heretofore there have been no efficient means for causing such action.

SUMMARY OF THE INVENTION

A principal object of the invention herein is to provide an improved wiper for use in wiping excess cosmetics from an applicator rod and applicator being removed from a cosmetics bottle.

Another object of the invention herein is to provide a wiper which is well adapted for use with highly viscous or fixitropic cosmetics.

An additional object of the invention herein is to provide a wiper which resists the build-up of wiped excess cosmetics in the area of the wiper orifice and head space of a cosmetics bottle.

A further object of the invention herein is to provide a wiper which blends and mixes cosmetics as an adjunct to its wiping action.

Yet another object of the invention herein is to provide a wiper which achieves the foregoing objects and which is relatively simple and inexpensive to fabricate.

In accomplishing these and other objects of the invention herein, there is provided a wiper for use in a cosmetics container having a bottle with a neck and an applicator rod and applicator, the wiper removing excess viscous cosmetics from the applicator rod and applicator as they are withdrawn through the neck of the container. The wiper includes a wiper diaphragm adapted for mounting in the neck of the bottle, the wiper diaphragm defining a wiper orifice and including a lower surface extending outwardly from the wiper orifice. The wiper further includes a plurality of spaced-apart vanes extending downwardly from the lower surface of the wiper diaphragm and angularly outwardly from the wiper orifice, the plurality of spaced-apart vanes defining a plurality of flow channels therebetween for carrying excess cosmetics away from the wiping orifice. Mixing of cosmetics is also accomplished in the flow channels defined between the spaced-apart vanes.

According to one aspect of the invention, the wiper diaphragm descends from the neck of the bottle and, as a particular aspect, the lower surface of the wiper diaphragm is conical. Associated with that aspect of the invention are blades which extend from the lower surface of the wiper diaphragm to below the orifice.

According to another aspect of the invention, the vanes are curved and as particular aspects, the vanes lead tangentially away from the wiper orifice and the vanes terminate tangentially to the outer diameter of the wiper diaphragm. Also, the trailing edge of one vane overlaps the leading edge of the next adjacent vane, and the number of vanes is three.

According to a further aspect of the invention herein, each vane has an angled leading edge and, according to a more particular aspect, each vane has a cusp adjacent a sharp leading edge for biting into the excess cosmetics and establishing an outward flow through the flow channels defined between the spaced-apart vanes.

According to an additional aspect of the invention, the wiper diaphragm is provided at the lower end of a sleeve which fits into the neck of the bottle, and a second, finishing wiper having a second wiper orifice is mounted within the sleeve. Also, the finishing wiper provides more flexible final wiping action to the applicator rod and applicator as they are withdrawn from the cosmetics bottle.

The various features of novelty which characterize the invention are pointed out with particularity in the claims annexed to and forming a part of this specification. For a fuller understanding of the invention, its operating advantages and specific objects attained by its use, reference is made to the accompanying drawings and descriptive matter in which the preferred embodiments are illustrated.

DRAWINGS

The same reference numerals refer to the same elements throughout the various figures.

DESCRIPTION OF PREFERRED EMBODIMENTS

Figure 7:
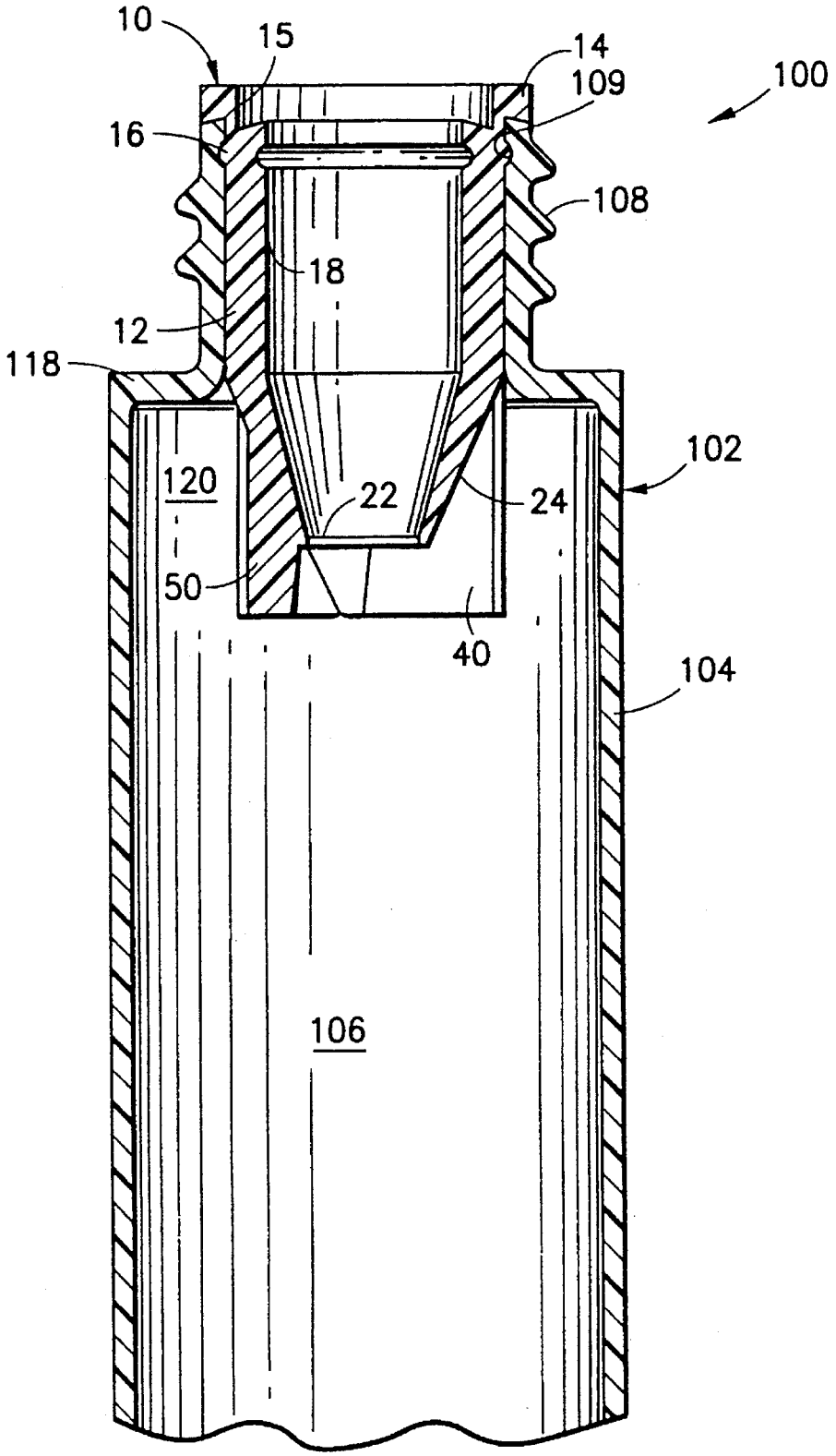
FIG. 7 is a sectional view of the wiper of FIG. 1 in the orientation shown in FIG. 6, with the wiper mounted in the bottle of a cosmetics container.
Figure 8:
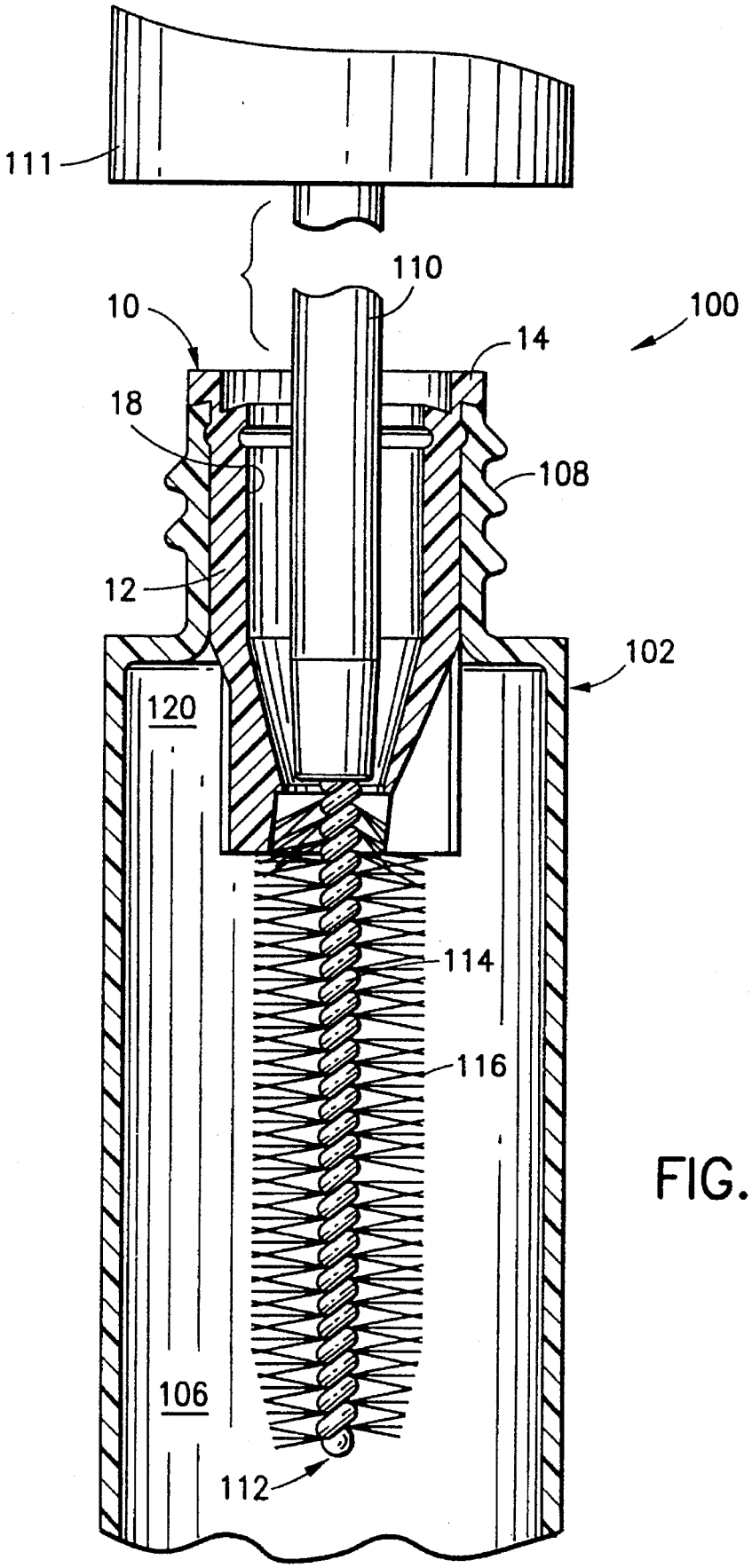
FIG. 8 is a sectional view of the wiper of FIG. 1 mounted in the bottle of a cosmetics container, similar to FIG. 7, and further including an applicator rod and applicator of the cosmetics container.

FIGS. 1–6 illustrate a wiper 10 according to the invention herein, and FIGS. 7–8 illustrate the wiper 10 as a part of a cosmetics container 100. In addition to the wiper 10, the cosmetics container 100 comprises a bottle 102 having a body 104 defining a chamber 106 in which cosmetics, not shown, are packaged, and a threaded neck 108. An applicator rod 110 extends from a cap 111, which is removably secured on the threaded neck 108 of the bottle 102. The applicator rod mounts an applicator brush 112 upon the distal end thereof, the brush 112 having a twisted wire stem 114 and radially extending bristles 116, of the type generally used to apply mascara.

The chamber 106 of the bottle 102 contains high viscosity cosmetics, such as mascara. Other examples of such cosmetics are shadows and concealers, although they are generally applied with an applicator comprising a foam pad or the like rather than a brush. The bottle may also contain cosmetics which are thinner but benefit from blending. The wiper 10 scrapes cosmetics from the applicator rod 110 as it is withdrawn from the cosmetics chamber 106, and the wiper then removes excess cosmetics from the applicator brush 112 or other suitable applicator. In cosmetics containers with prior art wipers, the high viscosity cosmetics removed from the applicator rod and applicator tended to accumulate in the head space 120 of the bottle 102. The "head space" is that portion of the interior of the bottle adjacent the neck and immediately below the shoulder 118 transitioning to the neck 108, and the head space is thereby also adjacent to the wiper area. Excess cosmetics tends to accumulate in the head space 120 and can compromise both the function of the wiper and the quality of the cosmetics.

The directions up, down, vertical, lateral and other directions referred to in this specification are with reference to the bottle 102 sitting upright on a flat surface, as shown in FIGS. 7–11.

The wiper 10 according to the invention herein is adapted to channel wiped cosmetics away from the head space and back to the lower part of the chamber 106 of the bottle 102. As an added beneficial effect, the wiper 10 causes mixing or blending of wiped excess cosmetics, which is beneficial because high viscosity cosmetics can tend to separate into components during periods of storage.

The wiper 10 comprises a tubular sleeve 12 having a radially protruding flange 14 at the upper end thereof. The sleeve 12 is received in the threaded neck 108 of the bottle 102 with the flange 14 extending over the upper end of the neck. The sleeve 12 includes a peripheral bead 16 matingly received in a groove 109 on the interior of the threaded neck 108, to position and secure the wiper 10 in the threaded neck. The sleeve 12 extends substantially the length of the threaded neck 108 to shoulder 118 and defines an outlet opening 18 through the threaded neck 108.

The wiper 10 further comprises a conical wiper diaphragm 20 extending downwardly into the chamber 106 defined by the body 104 of the bottle 102. The wiper diaphragm defines an orifice 22 sized to accommodate and scrape the applicator rod 110 and wipe excess cosmetics from the applicator brush 112. The foregoing parts of the wiper 10 and their mounting in bottle 102 are substantially the same as a prior art wiper.

The wiper 10 according to the invention herein is characterized by a plurality of spaced-apart vanes extending downwardly from the lower surface 24 of the wiper diaphragm 20 and angularly outwardly from the wiper orifice 22. As used herein, the term "angularly outwardly" means that the vanes are each angled with respect to a radius extending outwardly from the wiper orifice 22, such that cosmetics flowing between adjacent vanes and the lower surface of the wiper diaphragm are provided with a lateral, outward component of motion, generally in the orientation indicated by arrow F in FIG. 5.

The wiper 10 comprises three spaced-apart vanes 30, 40, and 50 extending downwardly from the lower surface 24 of the wiper diaphragm 20 and angularly outwardly from the wiper orifice 22. The vanes 30, 40, and 50 extend below the wiper orifice 22 and are evenly spaced apart about the wiper diaphragm 20. Vane 30 is described in more detail below. Vanes 40 and 50 are of the same configuration and size and will be described where corresponding portions are more visible in the drawings.

Vane 30 has a sharp leading edge 31 which extends from wiper orifice 22 downwardly to one end of a generally crescent-shaped bottom surface 32. The leading edge 31 is angled, as best seen in FIGS. I and 3. An outer surface 33 of the vane 30 is vertical, and extends from the leading edge 31 to a substantially vertical trailing edge 34. As best in FIGS. 1 and 5, the vane 30 generally and the outer surface 33 particularly is configured as a spiral, being tangential to the wiper orifice 22 adjacent the leading edge 31 and being tangential to the larger diameter periphery of the wiper diaphragm 20 and sleeve 12 adjacent the trailing edge 34. The outer surface 33 of the vane 30 joins the lower surface 24 of the wiper diaphragm 20 at a transition 35, best seen in FIG. 1, and extends downwardly to the bottom 32. The transition 35 begins at the orifice and terminates at the outer periphery of the wiper diaphragm 20 and sleeve 12.

Figure 1:
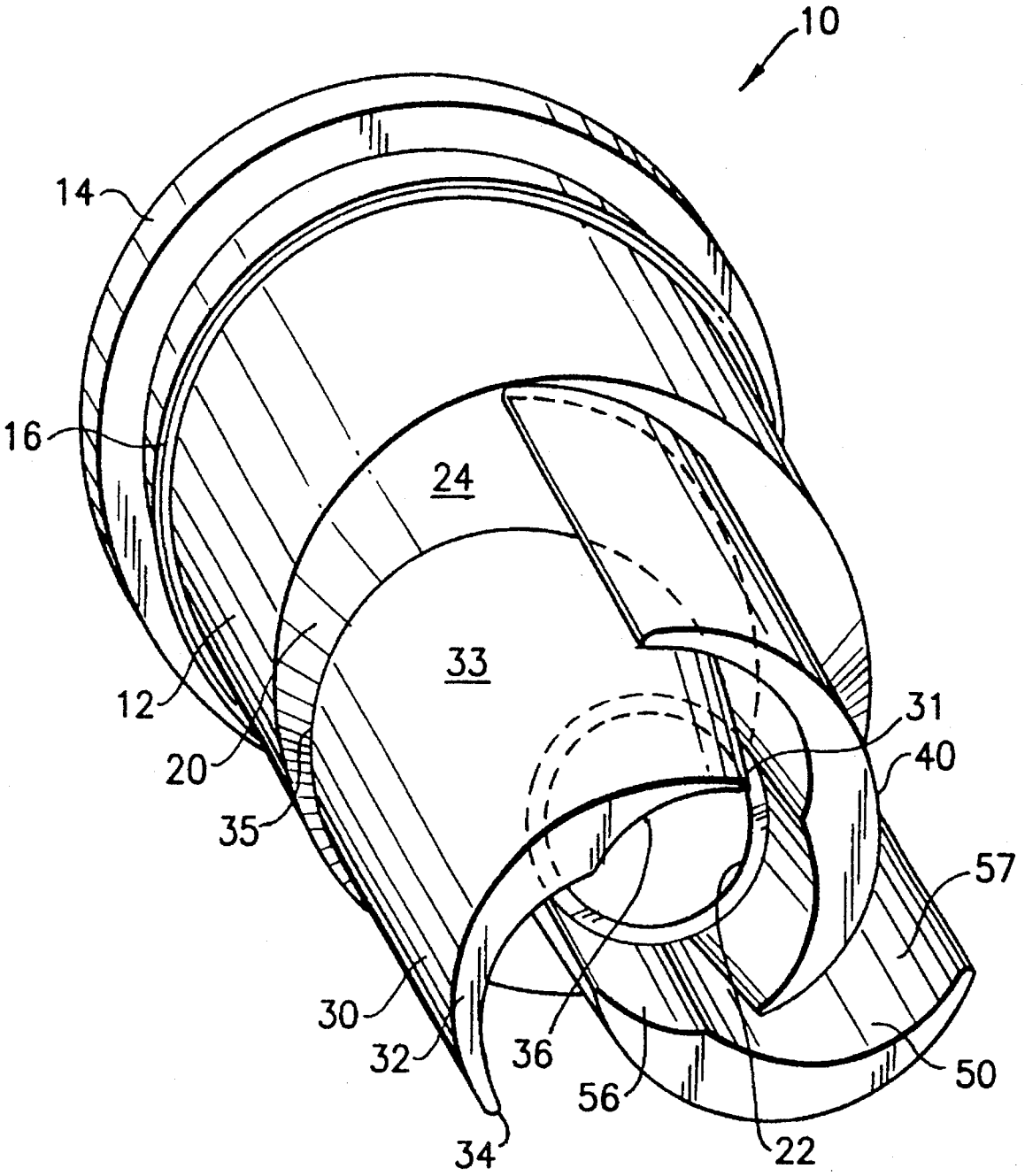
FIG. 1 is a perspective view of a wiper according to the invention herein, taken toward the lower end thereof.
Figure 3:
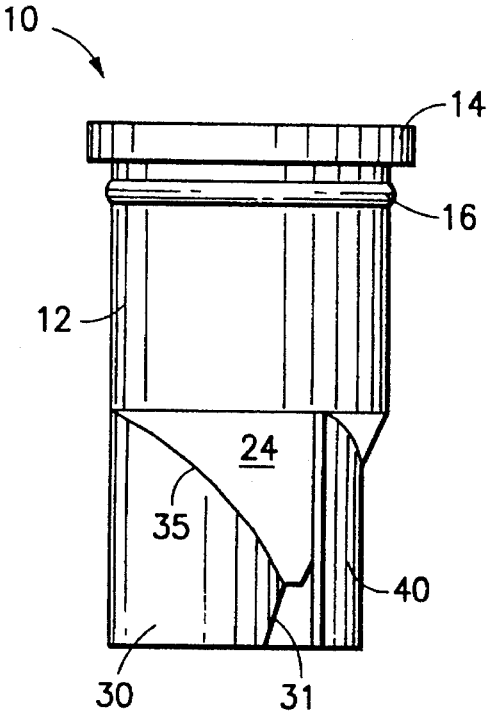
FIG. 3 is a side elevation view of the wiper of FIG. 1, rotated clockwise approximately 60° from the position shown in FIG. 2.
Figure 2:
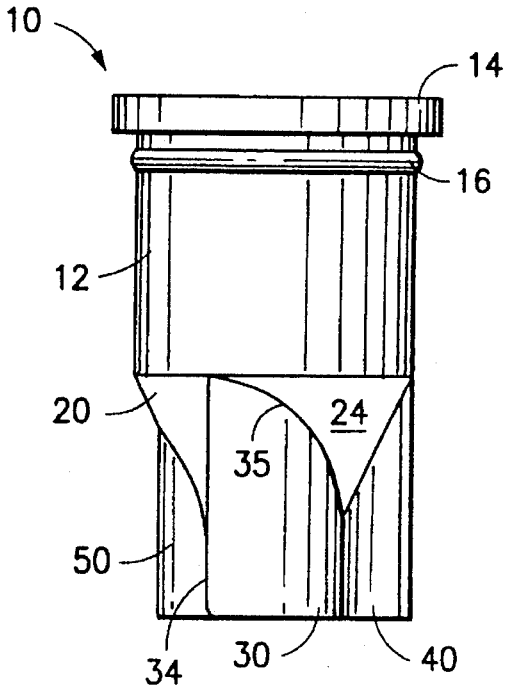
FIG. 2 is a side elevation view of the wiper of FIG. 1.
Figure 4:
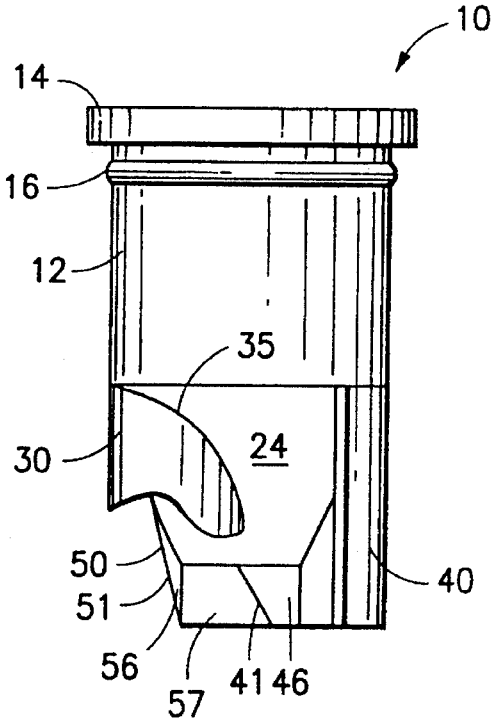
FIG. 4 is a side elevation view of the wiper of FIG. 1, shown in the same position as FIG. 3 and partially cut away.
Figure 5:
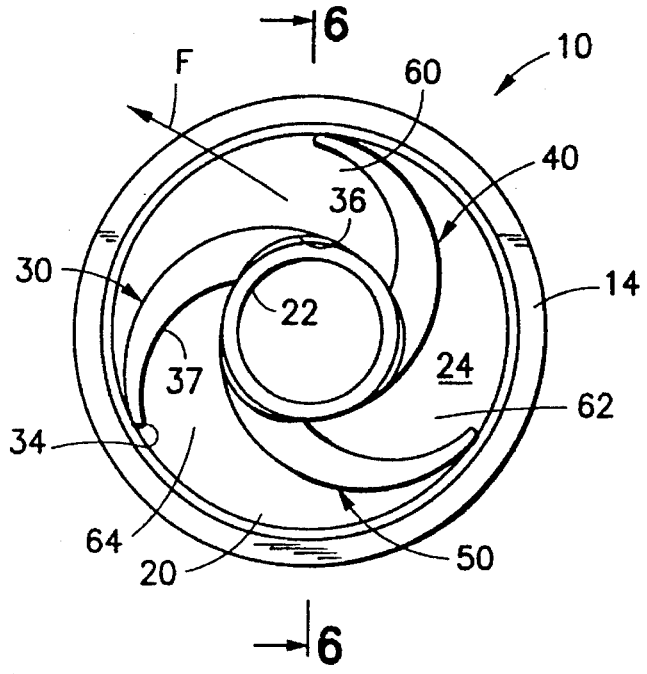
FIG. 5 is a bottom plan view of the wiper of FIG. 1.
Figure 6:
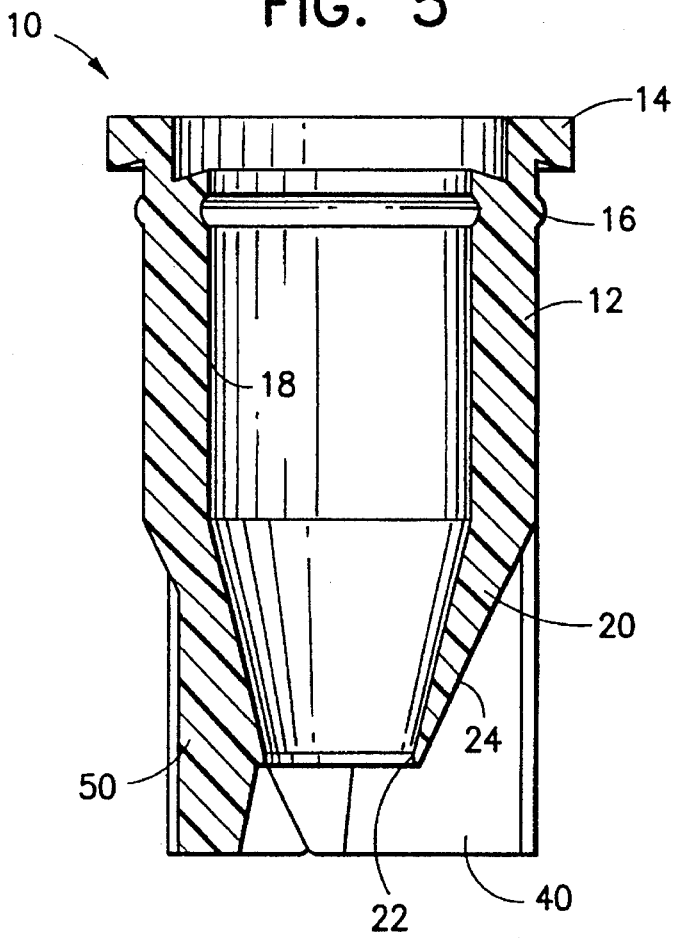
FIG. 6 is a sectional view of the wiper diaphragm of FIG. 1, taken along the lines 6—6 of FIG. 5 and corresponding to the position shown in FIG. 2.

The inner surface of the vane 30 is provided with a cusp 36, corresponding to cusp 56 of vane 50 which is better visible in FIG. 1. The cusp 36 is also seen in FIG. 5, and comprises a lower edge following the wiper orifice and a concave surface extending from the orifice to the crescent-shaped bottom 32. The inner surface of vane 30 further comprises a spiral portion 37, corresponding to portion 57 of vane 50, which extends from the cusp to the trailing edge 34. The cusp 36 permits the vane to be thicker in its central portion for purposes of strength, and is also believed to provide some turbulence and mixing in the flow of cosmetics over the inside of the vane 30.

As noted above, the other vanes are of the same size and configuration as vane 30, and with reference to the FIGS. 1–6, corresponding parts of the other vanes are seen. For instance, in FIG. 4, a portion of vane 30 is cut away so that the angled leading edge 41 and cusp 46 of vane 40 are visible, as are the angled leading edge 51 and cusp 56 of vane 50. The thick portion of the vane is also illustrated in the sectional views of FIGS. 6–8 and 9–11.

Each of the vanes 30, 40, and 50 extends over about 130 degrees of circumference of the wiper diaphragm 20 and sleeve 12 and, being evenly spaced apart, the trailing edge of one vane overlaps the leading edge of the adjacent vane. Adjacent vanes define a flow channel therebetween extending angularly outwardly from the orifice 22. Flow channel 60 is defined between vanes 30 and 40, flow channel 62 is defined between vanes 40 and 50, and flow channel 64 is defined between vanes 50 and 30 The flow channels are best seen in FIG. 5.

The wiper 10 is relatively rigid, so that the wiper diaphragm 20 and vanes 30, 40, 50 maintain their shapes during wiping action. It is advantageously fabricated of a low density polyethylene or a urethane with SHORE hardness of about 90–100 SHORE A.

With reference to FIG. 8, the operation of the cosmetics container 100 including wiper 10 is illustrated. As the applicator rod 110 and applicator brush 112 are withdrawn from the chamber 106, wiping action is effected by the leading edge of the vanes and by the wiper diaphragm defining the orifice. Cosmetics wiped from the applicator rod and brush are carried upwardly along the lower surface 24 of the wiper diaphragm 20 but are also turned and spun outwardly in the flow channels 60, 62, 64 defined between the vanes 30, 40, 50, with the cosmetics exiting the flow channels below the shoulder of the bottle. The excess cosmetics scraped from the applicator rod 110 is in the flow channels when the brush reaches the vanes, and because the vanes extend below the wiper orifice 22, the larger diameter profile of the bristles also act in the flow channels to thrust cosmetics through and out of the flow channels. Thus, the cosmetics tend to exit the wiper and drop back into the lower portion of the chamber 106, rather than adhering to the bottle in the head space 120. Further, cosmetics passing through the flow channels defined between adjacent vanes are subjected to turbulence and mixing action which is advantageous for reconstituting and reblending the cosmetics, including cosmetics which are not so viscous as to accumulate in the head space.

Figure 9:
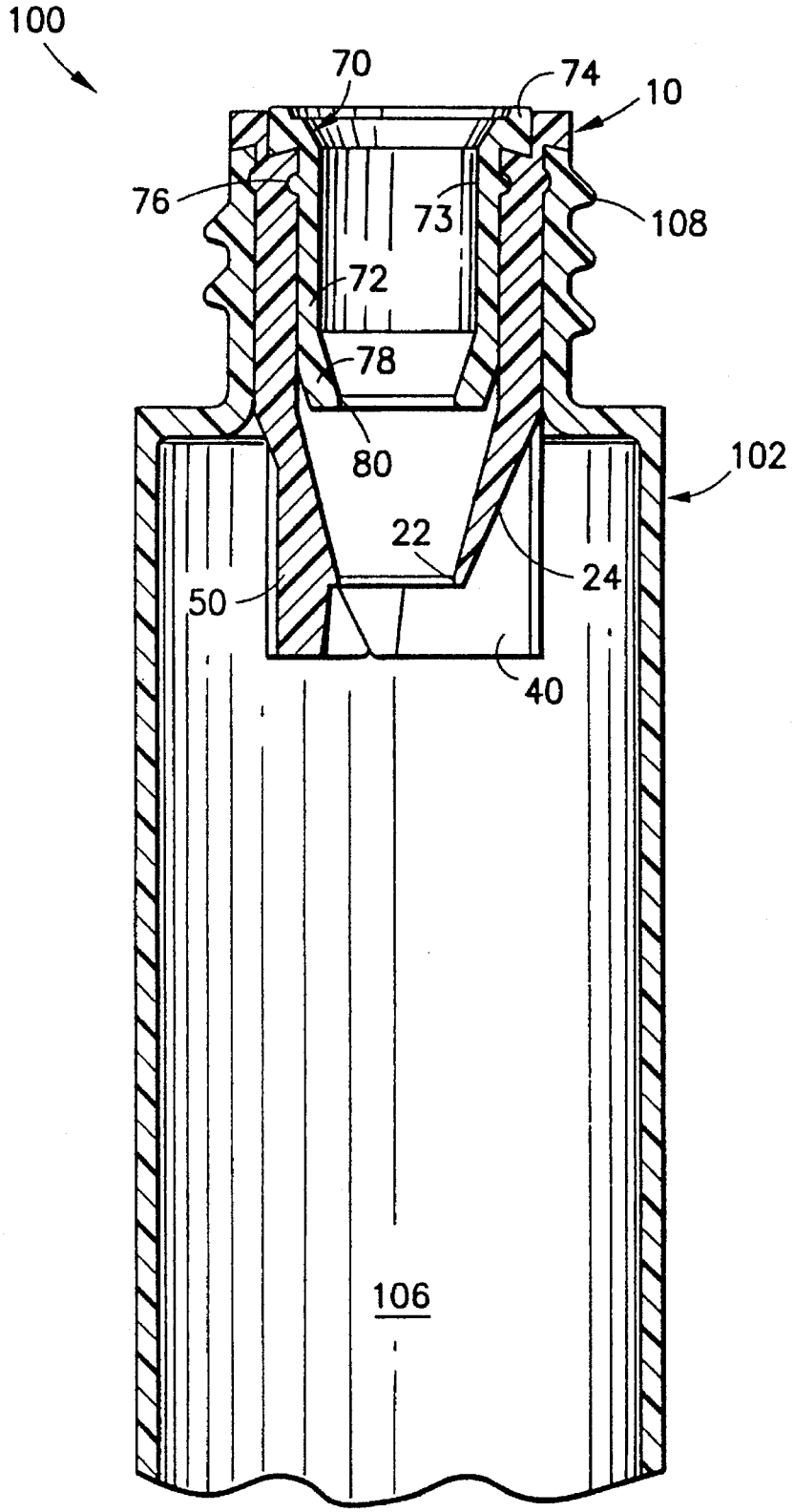
FIG. 9 is a sectional view of the wiper of FIG. 8 mounted in the bottle of a cosmetics container, similar to FIG. 7, and further including a second, finishing wiper.
Figure 10:
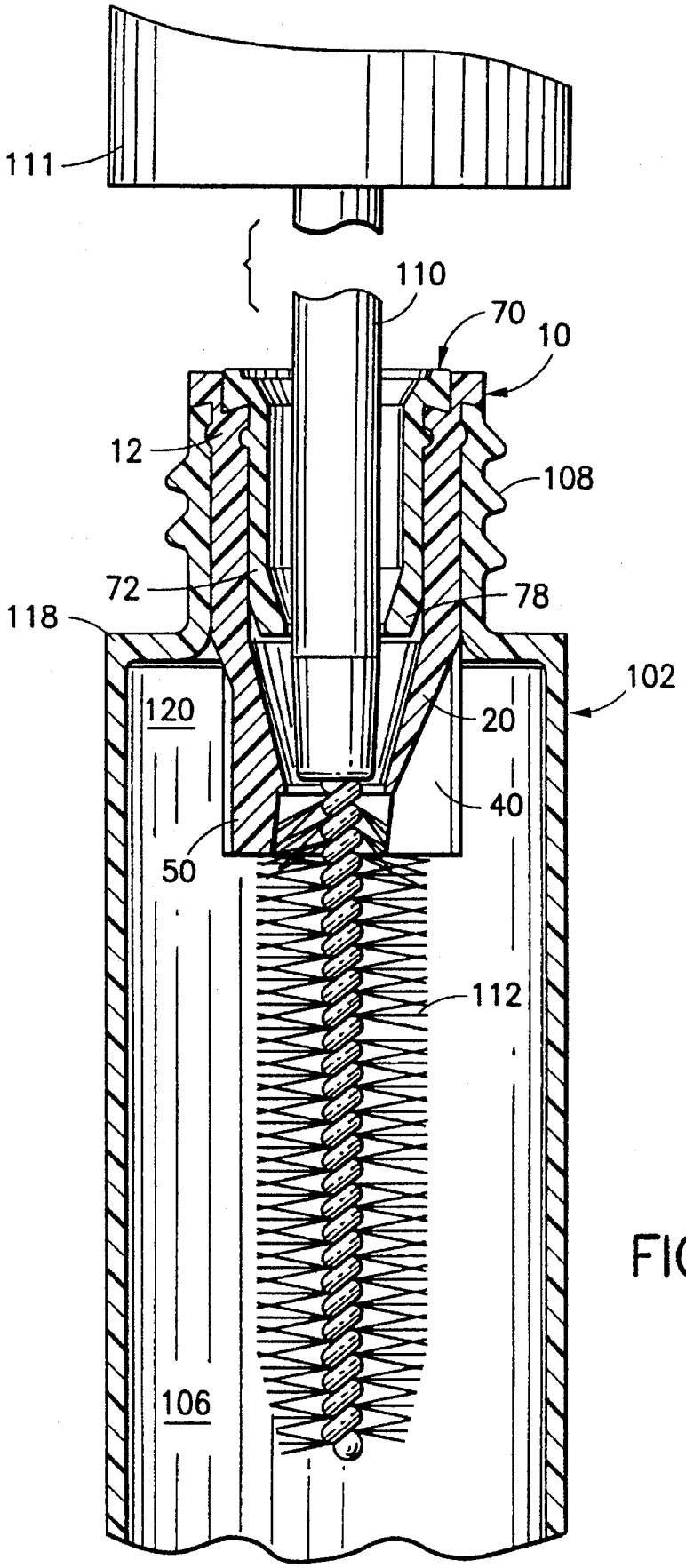
FIG. 10 is a sectional view of the wiper of FIG. I and the finishing wiper of FIG. 9, similar to FIG. 9, and further including an applicator rod and applicator of the cosmetics container.
Figure 11:
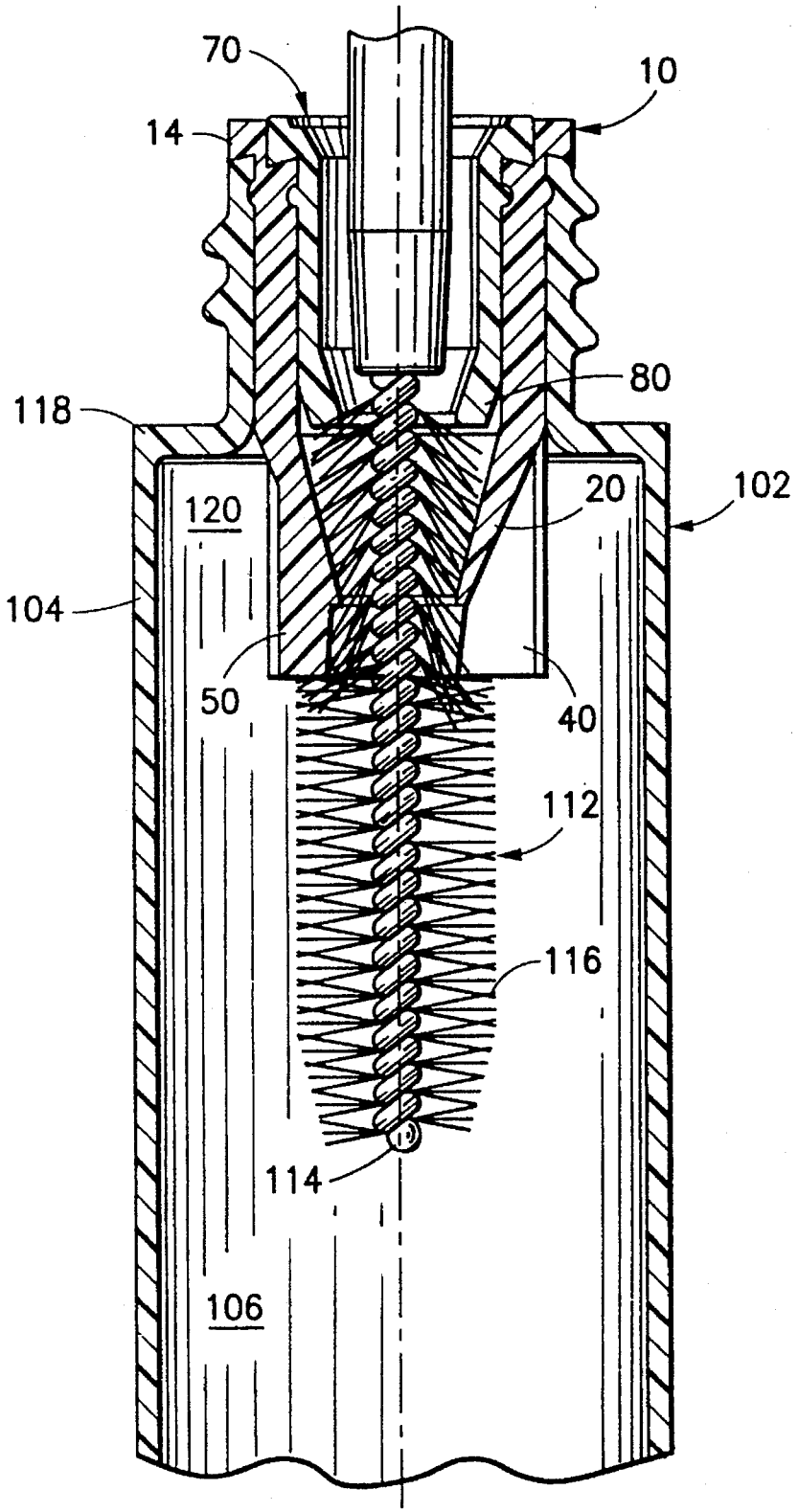
FIG. 11 is a sectional view similar to FIG. 10, with the applicator rod and applicator further withdrawn from the bottle of the cosmetics bottle.

With reference to FIGS. 9–11, the wiper 10 is shown augmented by a second, finishing wiper 70. The wiper 70 comprises a tubular sleeve 72 which fits in the sleeve 12 of wiper 10 and thereby defines a reduced diameter outlet passage 73 from the bottle 102. The wiper 70 has an upper radially protruding flange 74 received in a notch 15 in the wiper 10, and a cooperating bead and groove configuration 76 maintains the wiper 70 mounted in the wiper 10. The wiper 70 has a conical wiper diaphragm 78 defining a wiper orifice 80 of substantially the same diameter as the wiper orifice 22 and spaced upwardly therefrom. The wiper 70 provides a secondary "finishing" wipe to the applicator rod and applicator brush, as best seen in FIG. 11, and is advantageously fabricated of a more flexible material, such as neoprene, BUNA rubber, or urethanes at 50–75 SHORE A for that purpose.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. A wiper for use in a cosmetics container having a bottle with a neck and an applicator rod and applicator, the wiper removing excess cosmetics from the applicator rod and applicator as they are withdrawn through the neck of the container, the wiper comprising:

A) a wiper diaphragm adapted for mounting at the lower end of the neck of the bottle of a cosmetics container, the wiper diaphragm defining a wiper orifice and including a conical lower surface extending outwardly from the wiper orifice to an outer periphery of the wiper and descending from the outer periphery of the wiper to the wiper orifice;

B) a plurality of spaced-apart vanes extending downwardly from the lower surface of the wiper diaphragm and angularly outwardly from the wiper orifice; and C) a plurality of flow channels defined between adjacent spaced-apart vanes and the lower surface of the wiper diaphragm for carrying wiped excess cosmetics away from the wiper orifice.

2. A wiper as defined in claim 1 wherein the vanes are curved.

3. A wiper as defined in claim 1 and further comprising a tubular sleeve mounted in the bottle neck, the wiper diaphragm integral with and descending from the lower end of the tubular sleeve to the wiper orifice.

4. A wiper diaphragm as defined in claim 1 wherein a lower portion of the vanes extend below the wiper orifice.

5. A wiper as defined in claim 4 wherein the vanes are curved.

6. A wiper diaphragm as defined in claim 5 wherein a portion of each vane adjacent the wiper orifice is tangent thereto.

7. A wiper as defined in claim 6 wherein the vanes each comprise a sharp leading edge angled from the wiper orifice to a bottom of the vane.

8. A wiper as defined in claim 7 wherein each vane comprises an inside surface and the portion of the inside surface adjacent the angled leading edge is a cusp.

9. A wiper as defined in claim 8 wherein a portion of each vane adjacent to the outer periphery of the wiper diaphragm is tangent thereto.

10. A wiper as defined in claim 9 wherein the plurality of vanes comprises three vanes.

11. A wiper as defined in claim 10 wherein the trailing edge of each vane overlaps the leading edge of the adjacent vane.

12. A wiper as defined in claim 1 wherein the plurality of vanes comprises three vanes.

13. A wiper diaphragm as defined in claim 1 wherein a portion of each vane adjacent the wiper orifice is tangent thereto.

14. A wiper as defined in claim 13 wherein a portion of each vane adjacent to the outer periphery of the wiper diaphragm is tangent thereto.

15. A cosmetics container assembly for use in applying cosmetics, the cosmetics container comprising:

A) a bottle defining a chamber for containing cosmetics, the bottle including a threaded neck;

B) a cap removably secured to the neck, the cap having an applicator rod for extending through the neck into the cosmetics chamber and applicator at the distal end of the rod for carrying cosmetics from the cosmetics chamber upon removal of the cap, applicator rod and applicator from the bottle;

C) a first wiper having i) a first sleeve mounted in the bottle neck, the sleeve defining an outlet through the neck from the cosmetics chamber, ii) a conical wiper diaphragm extending from the sleeve across the outlet and having a conical lower surface descending into the cosmetics chamber below the neck, the conical wiper diaphragm defining a central wiper orifice for accommodating passage of the applicator rod and applicator and for wiping excess cosmetics therefrom as the applicator rod and applicator are withdrawn from the cosmetics chamber, iii) a plurality of substantially evenly spaced-apart vanes extending downwardly from the lower surface of the wiper diaphragm to below the wiper orifice, each vane having a leading edge and a trailing edge, the leading edge of each vane joined with the lower surface of the wiper diaphragm adjacent the wiper orifice, and each vane extending angularly outwardly from the wiper orifice to its trailing edge, and iv) adjacent vanes and the lower surface of the wiper diaphragm defining a flow channel therebetween for conveying wiped excess cosmetics outwardly from the wiper orifice, the plurality of vanes defining a plurality of said flow channels.

16. A wiper as defined in claim 15 wherein the vanes are curved.

17. A wiper diaphragm as defined in claim 16 wherein a portion of each vane adjacent the wiper orifice is tangent thereto.

18. A wiper as defined in claim 17 wherein the vanes each comprise a sharp leading edge angled from the wiper orifice to a bottom of the vane.

19. A wiper as defined in claim 18 wherein each vane comprises an inside surface and the portion of the inside surface adjacent the angled leading edge is a cusp.

20. A wiper as defined in claim 19 wherein a portion of each vane adjacent to the outer periphery of the wiper diaphragm is tangent thereto.

21. A wiper as defined in claim 20 wherein the plurality of vanes comprises three vanes.

22. A wiper as defined in claim 21 wherein the trailing edge of each vane overlaps the leading edge of the adjacent vane.

23. A cosmetics container as defined in claim 15 and further comprising:

D) a second, finishing wiper having:

i) a finishing wiper sleeve mounted in the first sleeve which is mounted in the bottle neck, and ii) a finishing wiper diaphragm extending across the outlet defined by the first sleeve and defining a finishing wiper orifice spaced upwardly from the conical wiper diaphragm.

24. A cosmetics container as defined in claim 23 wherein the second, finishing wiper is more flexible than the first wiper.

25. A cosmetics container as defined in claim 24 wherein the first wiper has a SHORE A hardness in the range of 80–100 and the second finishing wiper has a SHORE A hardness in the range of 50–75.

* * * * *